US005178291A

United States Patent [19]

Piercey

[11] Patent Number: 5,178,291

[45] Date of Patent: Jan. 12, 1993

[54] NURSING LID CONSTRUCTION FOR A NURSING BOTTLE

[76] Inventor: Vickie D. Piercey, 2382 Sunset Dr., Bishop, Calif. 93514

[21] Appl. No.: 859,940

[22] Filed: Mar. 30, 1992

[51] Int. Cl.[5] ..... A61J 11/00

[52] U.S. Cl. ..... 215/11.1; 248/102; 215/DIG. 8; 604/77; 604/78; 604/83

[58] Field of Search ..... 215/11.1, DIG. 8, 11.4, 215/11.5; 248/102, 104, 105; 604/77, 78, 83

[56] References Cited

U.S. PATENT DOCUMENTS

| | | | |
|---|---|---|---|
| 1,987,132 | 1/1935 | Shine | 248/104 |
| 2,680,441 | 6/1954 | Krammer | 215/11.1 X |
| 2,733,883 | 2/1956 | Gourley | 248/102 X |
| 3,058,708 | 10/1962 | Murray et al. | 248/102 |
| 3,405,829 | 10/1968 | Siravo | 215/11.1 X |
| 3,682,344 | 8/1972 | Lopez | 215/11.1 |
| 4,050,600 | 9/1977 | Jennings | 215/11.1 |
| 4,821,895 | 4/1989 | Roskilly | 215/11.1 |
| 4,984,697 | 1/1991 | Kelly | 215/11.1 |
| 5,105,956 | 4/1992 | Tarng-Lin | 215/11.1 |

*Primary Examiner*—Allan N. Shoap
*Assistant Examiner*—Paul A. Schwarz
*Attorney, Agent, or Firm*—Leon Gilden

[57] ABSTRACT

A nursing lid includes an internally threaded skirt, wherein the skirt includes a positioning web extending orthogonally relative to the skirt in a surrounding relationship, with the positioning web terminating in a reinforcing rib of a circular construction arranged about a perimeter of the web. The lid further includes a lid top web formed with an opening for mounting a nipple therethrough. The positioning web permits orientation of the nursing bottle upon a support surface to maintain fluid at a spaced relationship relative to the nipple to minimize leakage therethrough.

1 Claim, 4 Drawing Sheets

NURSING LID CONSTRUCTION FOR A NURSING BOTTLE

BACKGROUND OF THE INVENTION

1. Field of the Invention

The field of invention relates to nursing bottle construction, and more particularly pertains to a new and improved nursing lid contruction wherein the same is arranged to displace fluid from a nursing bottle relative to a nursing nipple mounted to the bottle.

2. Description of the Art

Nursing bottles and lids of various types have been utilized in the prior art, whereupon typically, in the positioning of a nursing bottle upon a support surface in a horizontal orientation, fluid is permitted to seep through the nipple. In an effort to overcome deficiencies of the prior art, the instant invention employs a positioning web to displace the nursing nipple relative to the support surface to displace fluid therefrom. Prior art structure relative to nursing nipple apparatus is exemplified in U.S. Pat. No. 4,778,068 to Kohus, as well as the U.S. Pat. Nos. 4,730,744 and 3,650,271.

Accordingly, it may be appreciated that there continues to be a need for a new and improved nursing lid construction as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of nursing bottle construction now present in the prior art, the present invention provides a nursing lid construction arranged to tip the nursing bottle relative to a support surface to displace fluid from within the nursing bottle relative to the nursing bottle outlet. As such, the general purpose of the present invention, which will be described subsequently in greater detail, is to provide a new and improved nursing lid construction which has all advantages of the prior art nursing lid construction and none of the disadvantages.

To attain this, the present invention provides a nursing lid including an internally threaded skirt, wherein the skirt includes a positioning web extending orthogonally relative to the skirt in a surrounding relationship, with the positioning web terminating in a reinforcing rib of a circular construction arranged about a perimeter of the web. The lid further includes a lid top web formed with an opening for mounting a nipple therethrough. The positioning web permits orientation of the nursing bottle upon a support surface to maintain fluid at a spaced relationship relative to the nipple to mainimize leakage therethrough.

My invention resides not in any one of these features per se, but rather in the particular combination of all of them herein disclosed and claimed and it is distinguished from the prior art in this particular combination of all of its structures for the functions specified. There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of others structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved nursing lid construction which has all the advantages of the prior art nursing lid construction and none of the disadvantages.

It is another object of the present invention to provide a new and improved nursing lid construction which may be easily and efficiently manufactured and marketed.

It is a further object of the present invention to provide a new and improved nursing lid construction which is of a durable and reliable construction.

An even further object of the present invention is to provide a new and improved nursing lid construction which is susceptible of a low cost of manufacture with regard to both materials and labor, and which accordingly is then susceptible of low prices of sale to the consuming public, thereby making such nursing lid construction economically available to the buying public.

Still yet another object of the present invention is to provide a new and improved nursing lid construction which provides in the apparatuses and methods of the prior art some of the advantages thereof, while simultaneously overcoming some of the disadvantages normally associated therewith.

These together with other objects of the invention, along with the various features of novelty which characterize the invention, are pointed with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
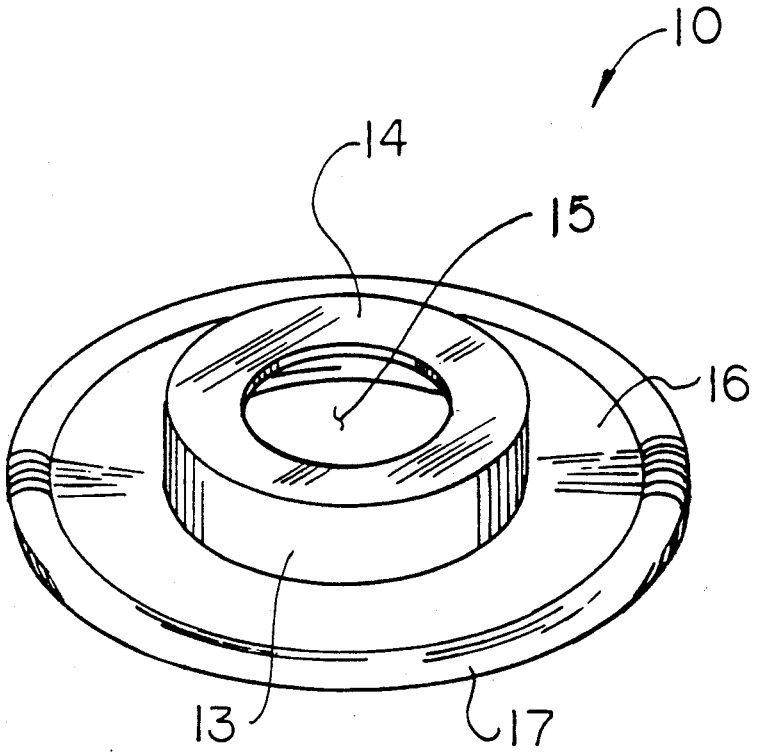
FIG. 1 is an isometric illustration of the lid construction of the invention.

With reference now to the drawings, and in particular to FIGS. 1 to 11 thereof, a new and improved nursing lid construction embodying the principles and concepts of the present invention and generally designated by the reference numeral 10 will be described.

Figure 2:
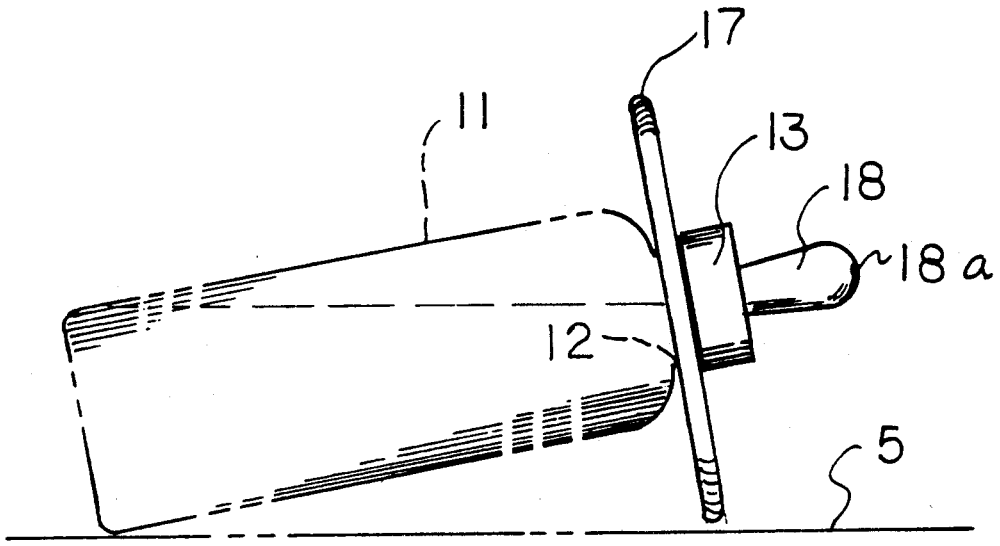
FIG. 2 is an orthographic side view of the lid in use.
Figure 3:
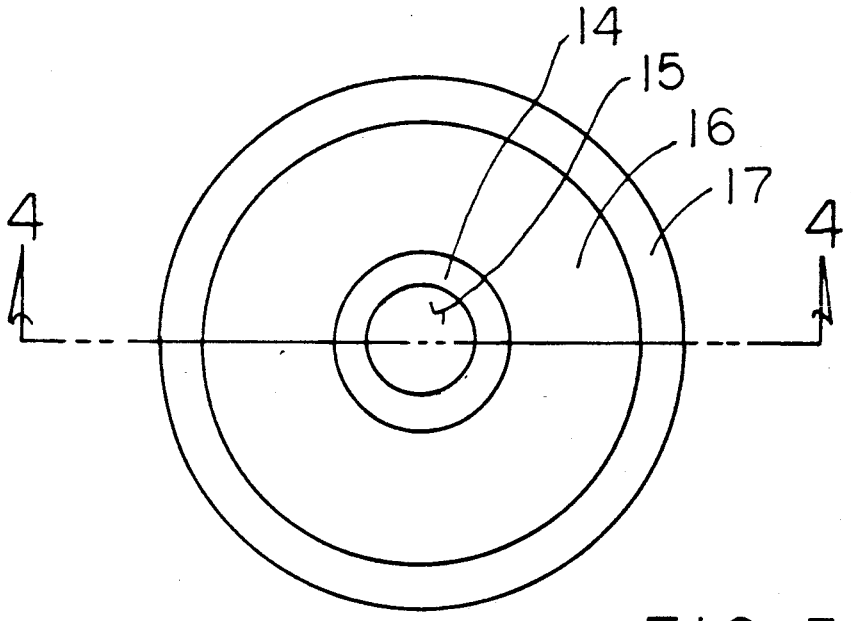
FIG. 3 is an orthographic top view of the lid.
Figure 4:
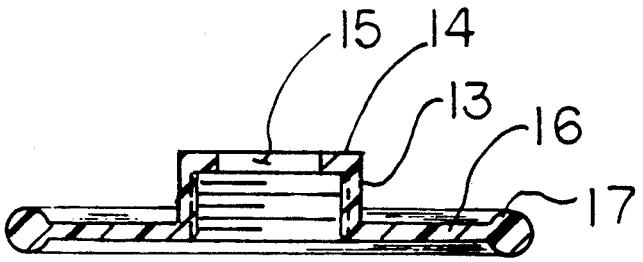
FIG. 4 is an orthographic view, taken along the lines 4—4 of FIG. 3 in the direction indicated by the arrows.
Figure 5:
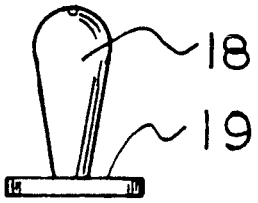
FIG. 5 is an orthographic side view of the nipple utilized in the invention.

More specifically, the nursing lid construction 10 of the instant invention essentially comprises mounting to a nursing bottle 11 having an externally threaded neck 12. The externally threaded neck 12 is threadedly received within a cylindrical internally threaded skirt 13 of the nursing lid 10. The skirt 13 includes a top web 14 orthogonally oriented relative to the skirt 13 at an upper distal end of the skirt 13, with a top web 14 having a central circular web opening 15 to receive a nipple 18 therethrough. The nursing nipple 18 (see FIG. 5) includes a nursing nipple flange 19 for positioning to a bottom surface of the top web 14 within the skirt 13. An annular positioning web 16 is orthogonally and integrally mounted to a lower distal end of the skirt 13 extending exteriorly of the skirt and having an annular periphery formed with a reinforcing lip 17 thereabout. The reinforcing lip 17 is of a circular construction and generally torroidal in form, wherein the web 16 is defined by a predetermined thickness and the circular reinforcing lip 17 of a further predetermined thickness greater than the predetermined thickness to effect rigidity to the organization, while minimizing excess material for use in construction of the web 16. In this manner, a nursing bottle, as illustrated in FIG. 2, has its opening displaced upwardly relative to an underlying support surface "S" and thereby displace fluid from within a nursing bottle relative to the nipple 18 to minimize fluid to be lost through the nursing nipple opening 18*a* at an uppermost end of the nursing nipple.

Figure 6:
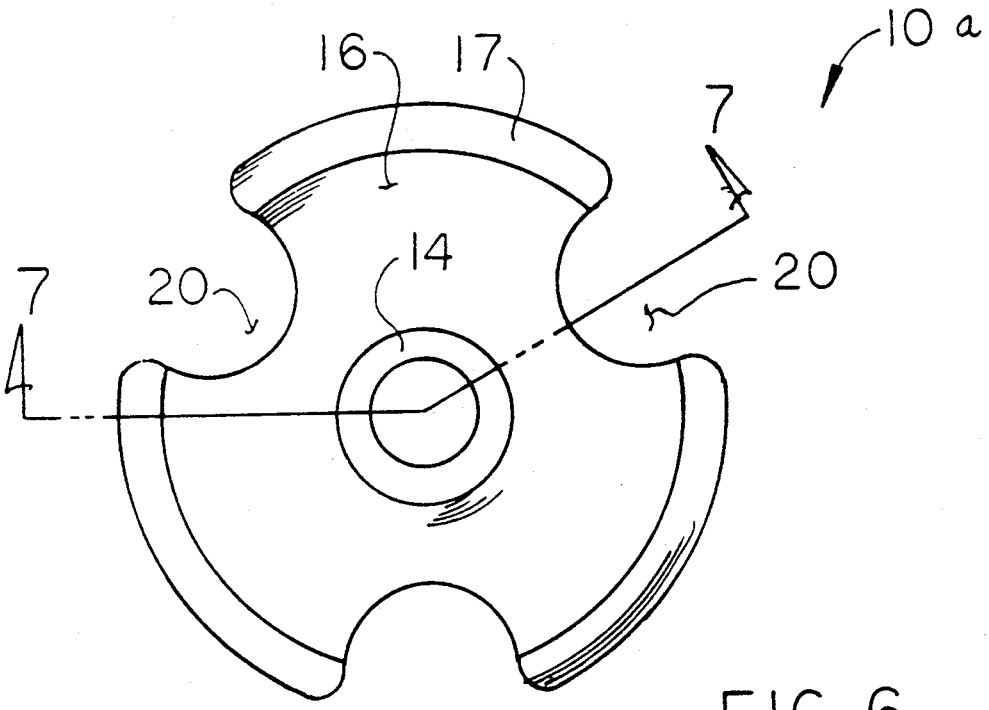
FIG. 6 is a modified lid of the invention.
Figure 7:
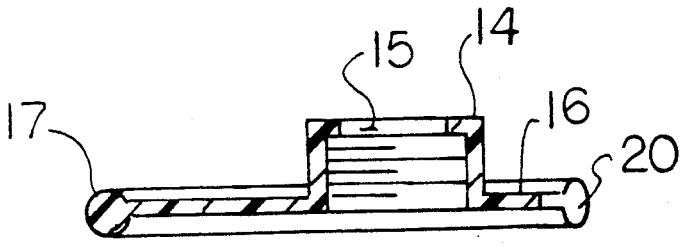
FIG. 7 is an orthographic view, taken along the lines 7—7 of FIG. 6 in the direction indicated by the arrows.
Figure 9:
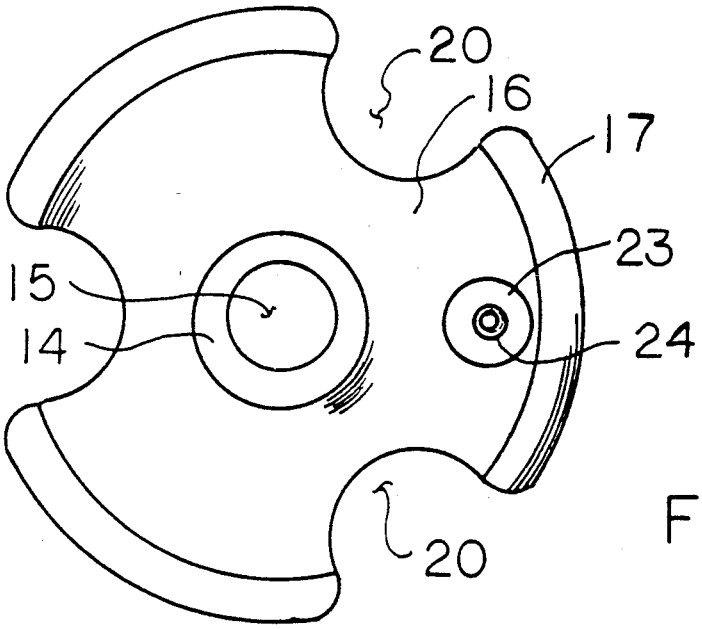
FIG. 9 is an orthographic top view of a yet further modified nursing lid of the invention.
Figure 10:
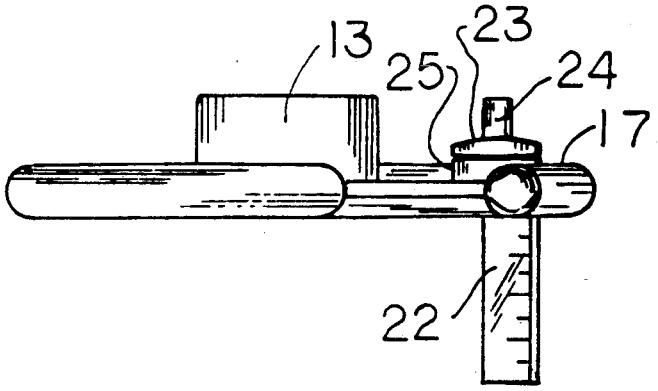
FIG. 10 is an orthographic side view of a nursing lid as set forth in FIG. 9.
Figure 11:
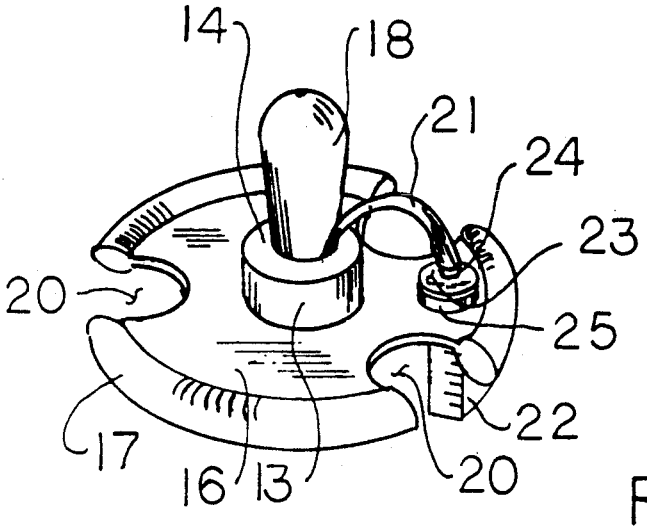
FIG. 11 is an isometric illustration of the further modified nursing lid in an assembled configuration.

The FIGS. 6 and 9 illustrate the web 16 formed with a discontinuous reinforcing lip 17 having spaced recesses 20 for a dual purpose of accommodating an infant's nose upon tipping of the bottle and to further provide for grasping recesses for ease of removal and securement of the skirt 13 about the neck 12 of the bottle container.

Figure 8:
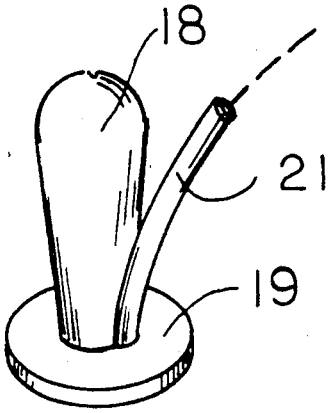
FIG. 8 is a further nursing type nipple utilized by the invention.

A further nipple construction as set forth in FIG. 8 further includes a vitamin conduit 21 mounted to the nipple and projecting in fluid communication therethrough at an intersection of the nipple 18 and the flange 19. A fluid reservoir 22 formed of a collapsible material is fixedly mounted to a bottom surface of the positioning web 16 and includes a reservoir cap 23 securable to a cap receiving boss 25 mounted to a top surface of the positioning web 16 as the cap receiving boss 25 is in fluid communication with the fluid reservoir 22. The reservoir cap 23 is threadedly removable relative to the cap receiving boss 25 and permits replenishment of vitamin fluid and the like, as well as other fluid additives to be directed into the nursing mixture of an infant in a metered manner, whereupon a sucking of the fluid from within the nursing bottle through the nipple 18, the vitamin fluid and the like is extracted from the collapsible fluid reservoir 22. It should be noted, that fluid reservoir 22 and the caps 23 includes a cap spout 24 for reception within the vitamin conduit 21 to effect fluid communication between the vitamin conduit 21 and contents of the reservoir 22 in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A nursing lid construction for use in combination with a bottle container, wherein the bottle container includes an externally threaded neck, and the nursing lid comprises, a cylindrical internally threaded skirt arranged for threadedly receiving an externally threaded neck therewithin, and the cylindrical skirt includes a skirt upper distal end and a skirt lower distal end, the skirt upper distal end includes a top web mounted coextensively to the skirt upper distal end, wherein the top web includes a central circular web opening, and a nursing nipple received through the central web opening, and the nursing nipple including a nursing nipple flange, the nursing nipple flange arranged for abutment to a bottom surface of the top web, and a positioning web integrally and orthogonally mounted to a lower distal end of the skirt projecting laterally beyond the skirt in a coextensive relationship relative to the skirt lower distal end, and the positioning web is of a circular configuration and the positioning web is arranged parallel relative to the top web in a spaced relationship, and the positioning web includes a circular reinforcing lip mounted coextensively to an outer periphery of the positioning web, wherein the circular reinforcing lip extends beyond the positioning web and the cylindrical skirt and the externally threaded neck of the nursing bottle, and the circular reinforcing lip is discontinuous and wherein a plurality of equally spaced recesses are directed into the positioning web from the reinforcing lip, and the nursing nipple includes a fluid vitamin directing conduit directed into the nursing nipple in fluid communication therethrough at an intersection of the nursing nipple and the nipple flange, and a collapsible flexible fluid reservoir mounted to a bottom surface of the positioning web spaced from the skirt, and the reservoir including a cap receiving boss mounted to a top surface of the positioning web, and a reservoir cap arranged for selective securement to the cap receiving boss to effect replenishment of fluid within the fluid reservoir, and the reservoir cap including a cap spout, the cap spout arranged for reception within the fluid conduit to effect communication between the reservoir and the nursing nipple.

* * * * *